US007296608B2

(12) United States Patent
Weishar et al.

(10) Patent No.: US 7,296,608 B2
(45) Date of Patent: Nov. 20, 2007

(54) IMPACTABLE DOOR

(75) Inventors: William B. Weishar, Brookfield, WI (US); Joseph M. Endter, Germantown, WI (US)

(73) Assignee: ASI Technologies, Inc., Milwaukee, WI (US)

( * ) Notice: Subject to any disclaimer, the term of this patent is extended or adjusted under 35 U.S.C. 154(b) by 438 days.

(21) Appl. No.: 10/821,007

(22) Filed: Apr. 8, 2004

(65) Prior Publication Data

US 2005/0028946 A1 Feb. 10, 2005

Related U.S. Application Data

(60) Provisional application No. 60/463,749, filed on Apr. 17, 2003.

(51) Int. Cl.
*E05D 15/06* (2006.01)

(52) U.S. Cl. ..... 160/200; 160/200; 160/214; 49/141

(58) Field of Classification Search ..... 160/205, 160/214, 200, 210, 212, 220; 49/141
See application file for complete search history.

(56) References Cited

U.S. PATENT DOCUMENTS 1,492,485 A * 4/1924 Shear ..... 160/200
1,783,378 A * 12/1930 Ferris ..... 160/200
2,279,572 A 4/1942 Kann
2,619,167 A 11/1952 Eckel
2,642,164 A 6/1953 McLean
2,720,920 A 10/1955 Eckel
2,760,567 A 8/1956 Eckel et al.
2,783,833 A 3/1957 Cann
2,815,808 A 12/1957 Eckel
2,843,201 A 7/1958 Laubenthal
2,878,532 A 3/1959 Clark (Continued)

FOREIGN PATENT DOCUMENTS

EP 163942 * 12/1985

(Continued)

OTHER PUBLICATIONS

Applicants' Exhibit A—RYTEC Corporation, Arctec High-Speed Sliding Door, Advertising Literature, Dated Sep. 2002.

(Continued)

*Primary Examiner*—Blair M. Johnson
(74) *Attorney, Agent, or Firm*—Quarles & Brady LLP

(57) ABSTRACT

An industrial sliding door has one or more panel assemblies, each panel assembly having a track panel secured to a header and a swinging panel hinged at the inner edge of the track panel to pivot in either direction about a vertical axis if the swinging panel is impacted by a vehicle such as a fork lift. Both panels can also pivot in at least one direction about a horizontal axis. A rail mounted stationary relative to the doorway at the lower edge of the door holds the lower edge of the door in proximity to the doorway and is disengagable if the door is hit from the opposite side, to permit the door panel assembly to swing about the horizontal axis away from the doorway. The swinging panel is held by a detent in the plane of the track panel in a normal position.

18 Claims, 17 Drawing Sheets

U.S. PATENT DOCUMENTS

| | | | | |
|---|---|---|---|---|
| 2,942,660 | A | | 6/1960 | Cann |
| 2,977,106 | A | | 3/1961 | Duff |
| 3,119,441 | A | * | 1/1964 | Furry, Jr. ..... 160/212 |
| 3,146,826 | A | | 9/1964 | Eckel |
| 3,175,254 | A | | 3/1965 | Bromann, Jr. |
| 3,197,817 | A | | 8/1965 | Voris |
| 3,212,561 | A | | 10/1965 | Eckel |
| 3,354,581 | A | * | 11/1967 | Kessner et al. ..... 49/141 |
| 3,420,290 | A | | 1/1969 | Dirubbo |
| 3,460,290 | A | | 8/1969 | Wutzke |
| 3,750,739 | A | | 8/1973 | McGuire |
| 3,805,450 | A | | 4/1974 | Forcina |
| 3,854,263 | A | | 12/1974 | Eckel |
| 3,979,872 | A | | 9/1976 | Gilchrist et al. |
| 4,027,715 | A | | 6/1977 | Tohma |
| 4,064,924 | A | | 12/1977 | Catlett |
| 4,122,887 | A | | 10/1978 | Dussault et al. |
| 4,180,942 | A | | 1/1980 | Saucier |
| 4,292,764 | A | | 10/1981 | Kochis |
| 4,402,159 | A | | 9/1983 | Domagalski |
| 4,646,471 | A | | 3/1987 | Shaiu |
| 5,347,755 | A | | 9/1994 | Jaster et al. |
| 5,727,614 | A | * | 3/1998 | Lichy ..... 160/201 |
| 6,330,763 | B1 | | 12/2001 | Kern et al. |
| 6,352,097 | B1 | | 3/2002 | Kern et al. |
| 6,360,487 | B1 | | 3/2002 | Kern et al. |
| 6,427,382 | B2 | * | 8/2002 | Gregoriou et al. ..... 49/27 |
| 6,938,665 | B2 | * | 9/2005 | Lewis et al. ..... 160/96 |
| 2002/0017060 | A1 | | 2/2002 | Kern et al. |
| 2004/0172882 | A1 | | 9/2004 | Kern et al. |

FOREIGN PATENT DOCUMENTS

| | | |
|---|---|---|
| EP | 0 914 536 B1 | 5/1999 |
| FR | 1.514.166 | 11/1966 |
| FR | 2.191.010 | 2/1974 |
| SE | 196048 | 5/1938 |
| WO | WO 01/18469 A1 | 3/2001 |

OTHER PUBLICATIONS

Applicants' Exhibit B—Admitted Prior Art.

* cited by examiner

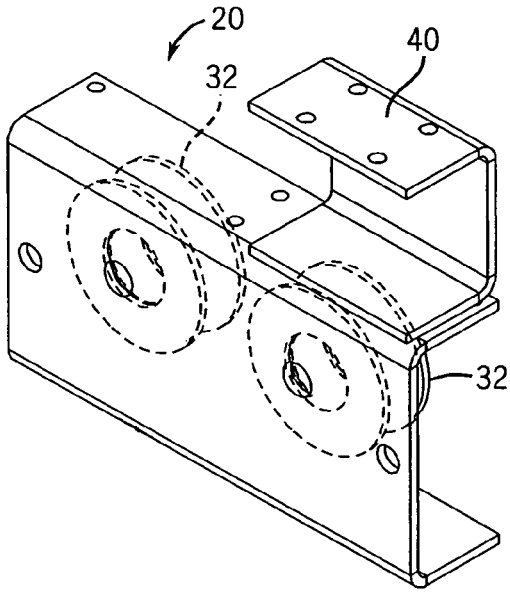
FIG. 4
FIG. 5
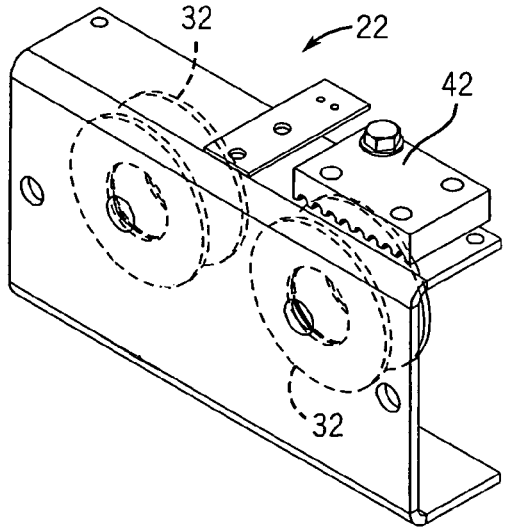
FIG. 6
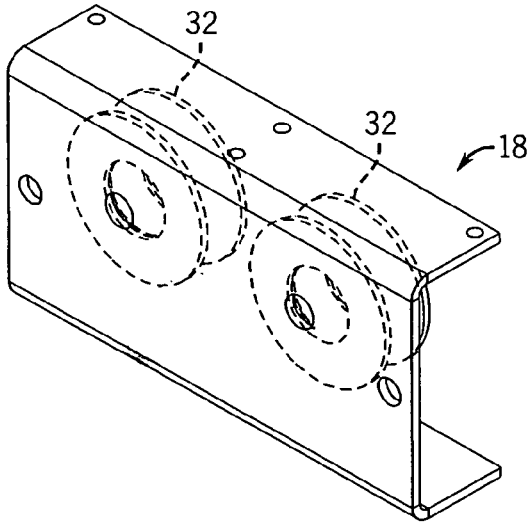

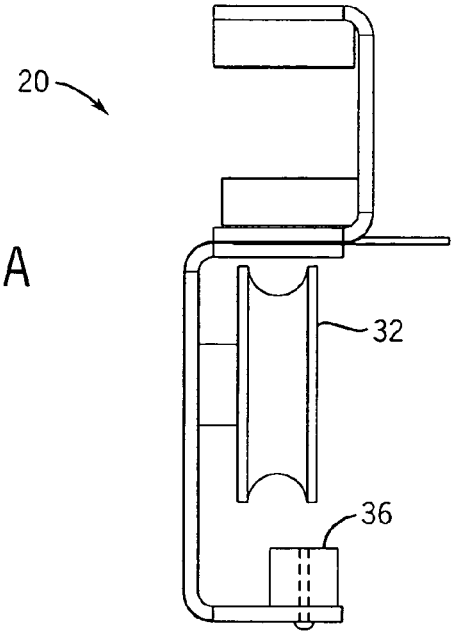
FIG. 7A
FIG. 7B
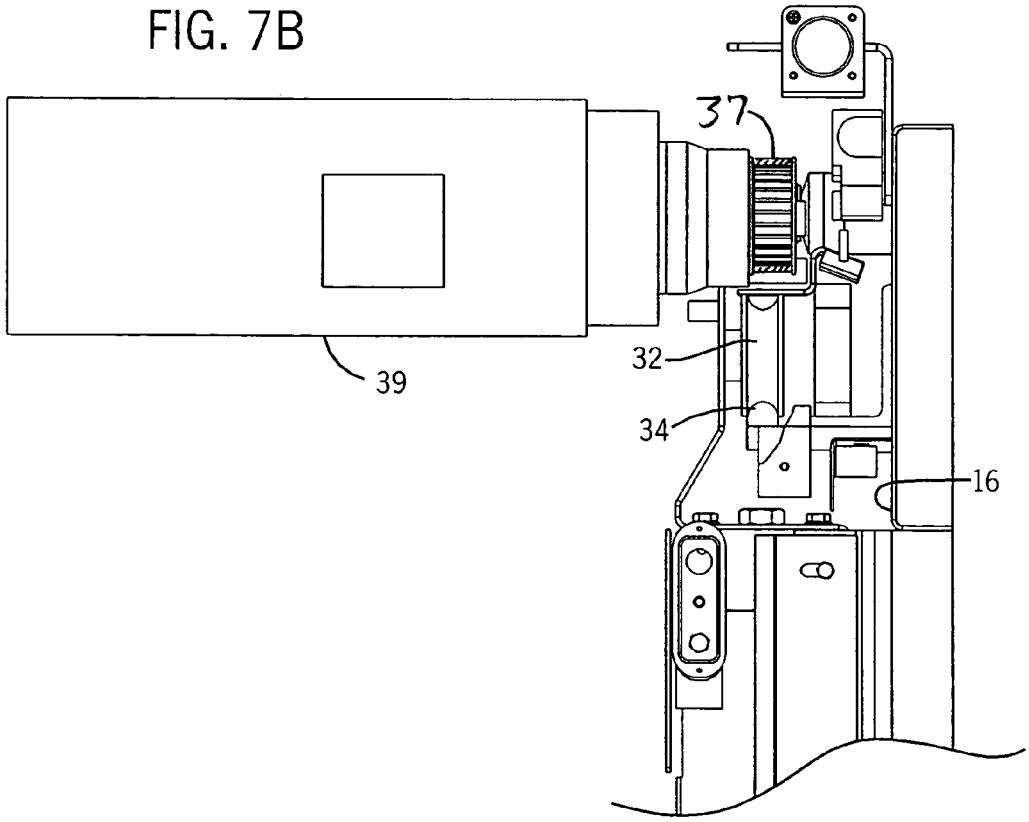

IMPACTABLE DOOR

CROSS-REFERENCE TO RELATED APPLICATION

This claims the benefit of the filing date of U.S. Provisional Patent Application Ser. No. 60/463,749 filed Apr. 17, 2003.

STATEMENT CONCERNING FEDERALLY SPONSORED RESEARCH OR DEVELOPMENT

Not applicable.

FIELD OF THE INVENTION

This invention relates to industrial doors, and in particular to a sliding industrial door that has features built into it to make it capable of enduring an accidental impact.

BACKGROUND OF THE INVENTION

Sliding doors for industrial applications are well known. For example, for a large scale industrial freezer, in which forklift trucks are continually coming in and out of the freezer, insulated sliding doors have been used. The sliding doors are typically suspended by trolleys that have wheels engaged on tracks which are mounted to the wall over the doorway. There may also be tracks on the walls at the bottom of the door to hold the bottom of the door close to the doorway. Two panels are typically provided which meet in the middle of the doorway and are operated by a belt which is power driven at the top of the doorway and has a lower run of the belt attached to one of the panels and an upper run of the belt attached to the other panel, so that when the belt is driven, the panels move away from one another to open the doorway. When the belt is driven in the other direction, the panels move together toward one another to close the doorway. The opening of the door is typically actuated by a motion detector, a pull cord connected to a switch or an induction loop in the floor that senses the presence of a vehicle. Although the sliding doors open and close with considerable speed, the forklifts also travel with considerable speed. Sometimes, when a door is opening or closing, the forklift may impact the door, usually adjacent to a leading edge of one of the door panels. When this happens, severe damage can occur to the door.

Prior art doors made to endure impacts such as this have typically been made of fabric covered foam or other soft materials, which can absorb impact without significant damage to the door. However, the materials of these doors have other disadvantages, including that they wear out, the severity of the impact that can be endured is quite limited, they are not easily cleaned, they absorb moisture, they can contribute to mold growth which is important in a food storage facility, and they can become torn, and do not present a structural or aesthetic appearance.

SUMMARY OF THE INVENTION

The present invention provides an impactable sliding door that addresses these issues. In a door of the invention, there is at least one door panel assembly having a track panel that is suspended from the track and slidable relative to the track so as to open and close the doorway and a swinging panel that is hingedly connected to the track panel so as to pivot about a generally vertical axis relative to the track panel so that it can pivot in either direction out of the plane of the track panel. Thereby, the swinging panel can move out of the way regardless of which side it is struck from.

The swinging panel is preferably held in the plane of the track panel, in a normal position, by a detent mechanism. The detent can be at the top of the swinging panel with one part of the detent on the swinging panel and the other part of the detent on a header that extends from the first panel inwardly over the second panel. The detent permits release of the door in either direction and the hinge connection of the swinging door panel to the track door panel permits the swinging door panel to pivot in either direction out of the plane of the track door panel, when it is impacted from one side or the other.

It is also preferred that the swinging door panel have a leading edge, that is the edge that contacts the leading edge of the other sliding door panel in a two door panel assembly where the two door panels meet in the middle of the doorway, or the edge that contacts the threshold of the doorway in a single door panel assembly door closing system. The leading edge is preferably provided by a foam or otherwise highly compressible and impact-absorptive material, which may be covered with a reinforced fabric like nylon or canvas. Each of the track and swinging door panel sections may primarily be made, however, of a structurally rigid material. Preferably, if the door is to be used in a freezer or refrigerated room application, the material is an insulating material and should be of light weight to reduce its inertia and therefore the accelerating force necessary to swing it open when it is impacted. The leading edge may also be provided with a pressure responsive sensor that detects if the leading edge has been compressed or impacted, and a sensor may also be provided that senses whether the swinging panel has been swung out of the plane of the track panel.

In addition, it is preferred that an impact resistant sheet be added to the outside, on both sides of the second panel, in the area of the second panel which is most likely to be hit by a fork lift, that is in the area of about the lower half of the door and over substantially the entire surface area of the structurally rigid part of the second door panel. For example, a ⅛ inch thick sheet of ultra high molecular weight polyethylene is such a material.

A soft leading edge of each door panel also contributes to sealing of the door when it is closed, either against the threshold of the doorway if it is a side closing door (having one door closing assembly), or against the leading edge of the other door panel assembly if it is a center closing door (having two door panel assemblies). The leading edges of the door panels may be provided with tubular or other structures that overlap when the doors are closed for better sealing.

In another aspect of the invention, the entire door panel assembly, including both the first and second panels, is able to be swung about a horizontal axis in at least one direction. In the preferred embodiment, the horizontal axis is provided by the connection between the trolley wheels and the track, which is a conventional connection for sliding industrial doors, each trolley wheel having an outer circumference that is concave so that the wheel can engage a similarly shaped convex rail of the track and be guided by the rail and pivot about the horizontal rail. The mating concave and convex shapes permit rotation of the trolley wheels about the rail so that the door panel assembly can be swung about a horizontal axis in the direction away from the adjacent wall to which the track is mounted.

Another feature of the present invention is that the bottom of the door is connected in a releasable fashion to a track that is fastened to the wall so that if the door is impacted and swung away from the wall, the connection can release. When the door is pivoted back into its normal operating position, which is generally in a vertical plane adjacent to the wall, the connection will automatically reengage to hold the bottom of the door adjacent to the wall as the door slides parallel to the wall and parallel to the doorway opening in the wall that the door closes. A feature can also be included that will automatically pivot the door back into a vertical plane, such as a re-engagement member that re-engages the door with the track when the door is fully opened.

These and other features and advantages of the invention will be apparent from the detailed description and drawings.

BRIEF DESCRIPTION OF THE DRAWINGS

FIG. 4 is a perspective view of the left-hand lead trolley for suspending a door assembly;

FIG. 5 is a perspective view of the right-hand lead trolley for suspending the right-hand door assembly;

FIG. 6 is a perspective view of a standard trolley which is used to suspend both door assemblies from the track;

FIG. 7A is an end view of the left-hand lead trolley shown in FIG. 4;

FIG. 7B is an end view of the track and drive components of the door;

DETAILED DESCRIPTION OF THE PREFERRED EMBODIMENT

Figure 1A:
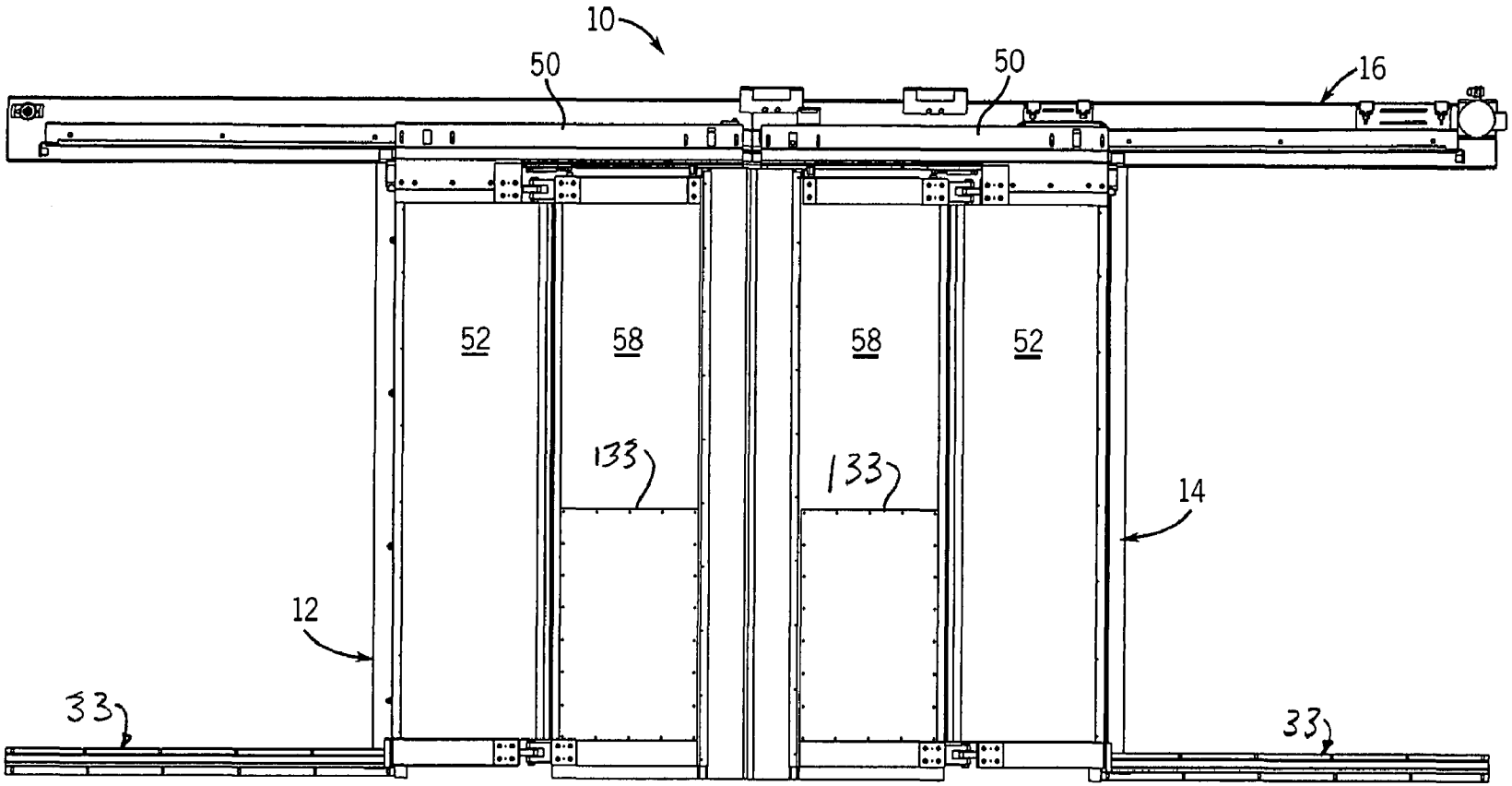
FIG. 1A is a front plan view of a two door panel assembly center closing door of the invention suspended from a track.

FIGS. 1A-D illustrate a door 10 including a left door panel assembly 12 and a right door panel assembly 14. The two door panel assemblies 12 and 14 are identical mirror images of one another. The door panel assemblies 12 and 14 are suspended from a track 16 in well-known manner by standard trolleys 18 at the outward top sides of each door panel assembly 12 and 14 and by a left-hand trolley 20 at the inward top side of the assembly 12 and by a right-hand trolley 22 at the inward top side of the assembly 14. The track 16 is bolted or otherwise affixed to a wall 30 (see FIG. 13) and, preferably, a lower rail 33 (FIG. 13) is also affixed to the wall 30 at the sides of the doorway opening, the lower rail 33 engaging a leaf spring extension of the door panel assembly to hold the lower end of the door panel assembly adjacent to the wall 30, as further described below. In well known fashion, the track 16 on each side of center angles down slightly toward center (in a bi-part door; down toward the closed side in a single part door) so that the bottom of the door is closer to the floor when it is closed, to compress elastomeric seal strips 141 (FIG. 13) at the bottom of the door against the floor.

Referring to FIGS. 2-7B, the trolleys illustrated in FIGS. 4-7 are affixed to a header 50 which is attached to the top of the track panel 52 of the door panel assembly 12 or 14 as described below. Each trolley 18, 20, and 22 includes a pair of rollers 32, each of which has a concave groove which defines its circumference. Each roller 32 receives a convex rail 34 (FIGS. 2 and 3) of the track 16. The shape of the rail 34 matches the convex shape of the circumference of each roller 32 such that the door panel assemblies 14 can swing in a direction away from the wall 30. The wall 30 being adjacent to the inside surfaces of the door 10 obviously keeps the door panels 12 and 14 from swinging in the direction toward the wall 30. When swinging about the axis defined by the concave surfaces of the rollers 32 and convex surface of rail 34, the door panel assemblies 12 and 14 swing about a horizontal axis, since the rail 34 and rollers 32 define an axis which has its orientation horizontal. As illustrated in FIG. 7A, the trolleys 18, 20, and 22 may also be provided with spacers 36 which keep the rollers 32 on the rail 34 in case an impact should ever tend to lift or dislodge the rollers 32 from the rail 34.

Figure 2:
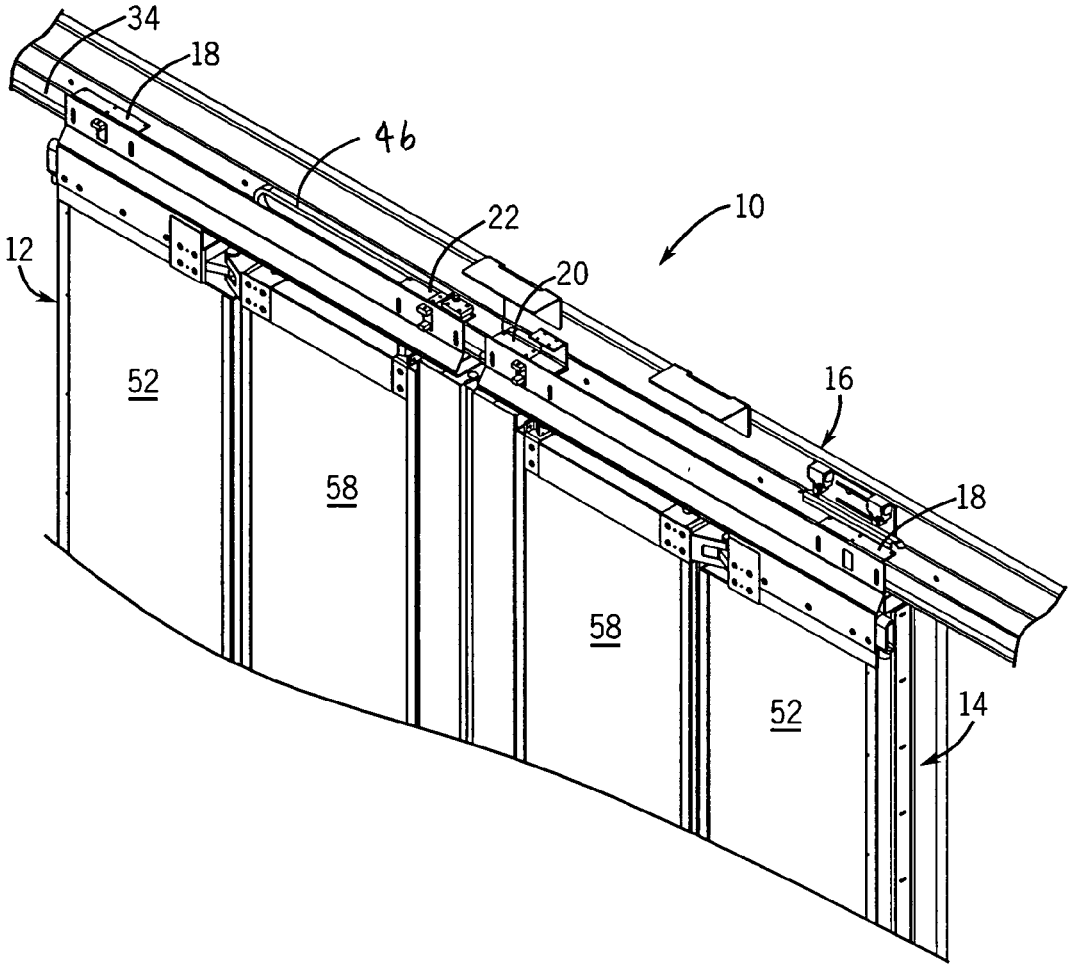
FIG. 2 is a detail view of the top portion of FIG. 1B.
Figure 3:
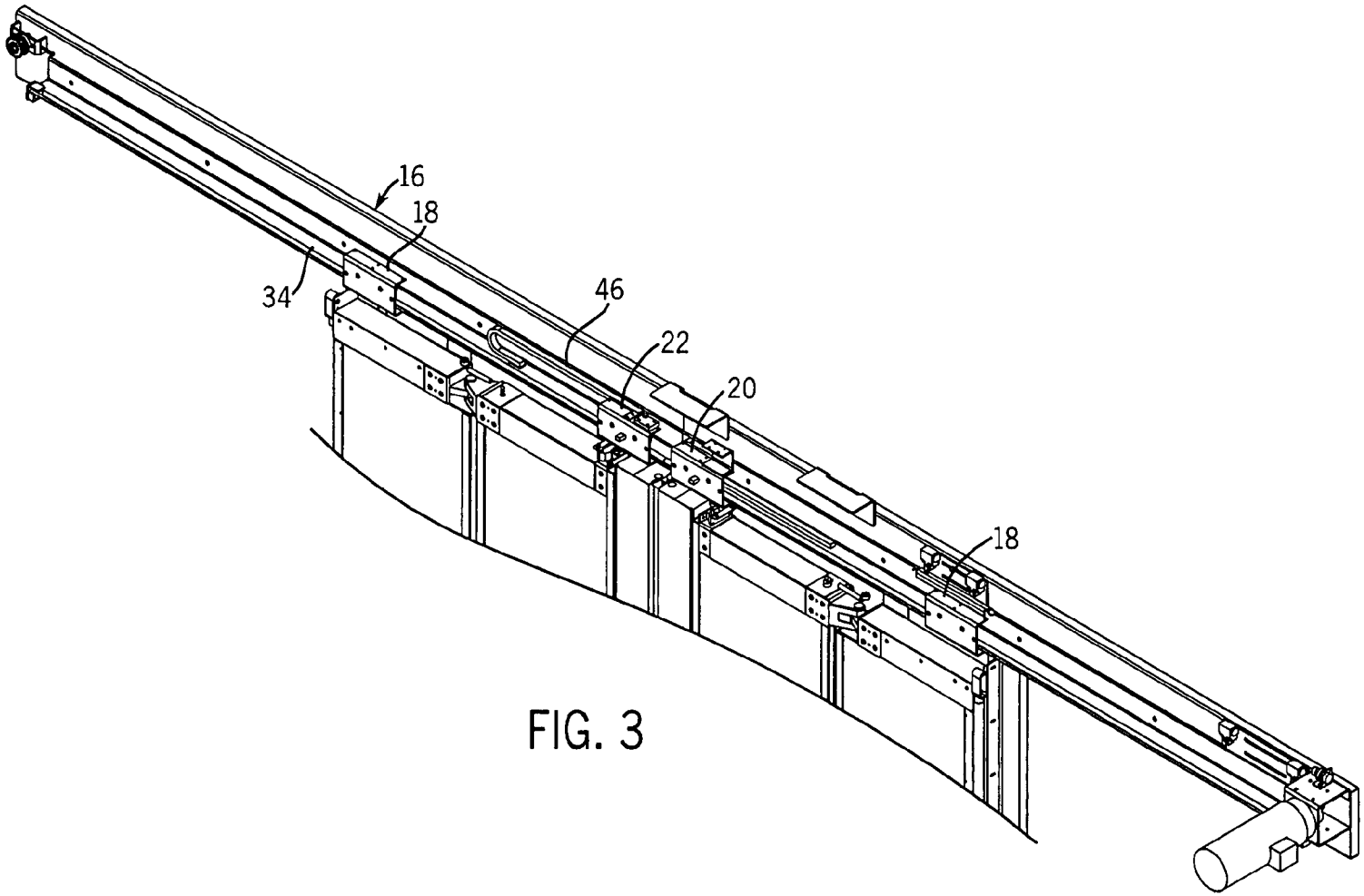
FIG. 3 is view like FIG. 2, but showing the track, trolleys and door panels with the door headers removed.

The door panel assemblies 12 and 14 are driven toward one another to close the doorway or away from one another to open the doorway (since they close in the middle of the doorway) by a power operated belt 37 in conventional fashion. The left-hand lead trolley 20 and the right-hand lead trolley 22 have respective drive attachments 40 and 42, with the attachment 40 being attached to the upper run of the drive belt 37 and the attachment 42 being attached to the lower run of the drive belt 37. When the drive belt 37 is driven by an electric motor 39 (FIG. 7B) in conventional fashion, for example to open the door, the upper run of the belt 37 moves to the right and the lower run moves to the left, driving the respective door panel assemblies 12 and 14 in the same respective directions. The opposite occurs when the door is closed, and the belt is driven in the opposite direction. The drive mechanisms, sensors (e.g., the motion detector that actuates the opening of the door), and related circuitry and hardware for opening and closing the door are well known and conventional. Any type of drive, sensors and circuitry could be used. Also illustrated in FIGS. 2 and 3 is an e-chain 46 which is a cable carrier that permits routing wires to the movable door assemblies 12 and 14 in a movable fashion, also well known in the art, and any suitable means of supplying power to the moving components of the door that require power could be used.

Figure 8:
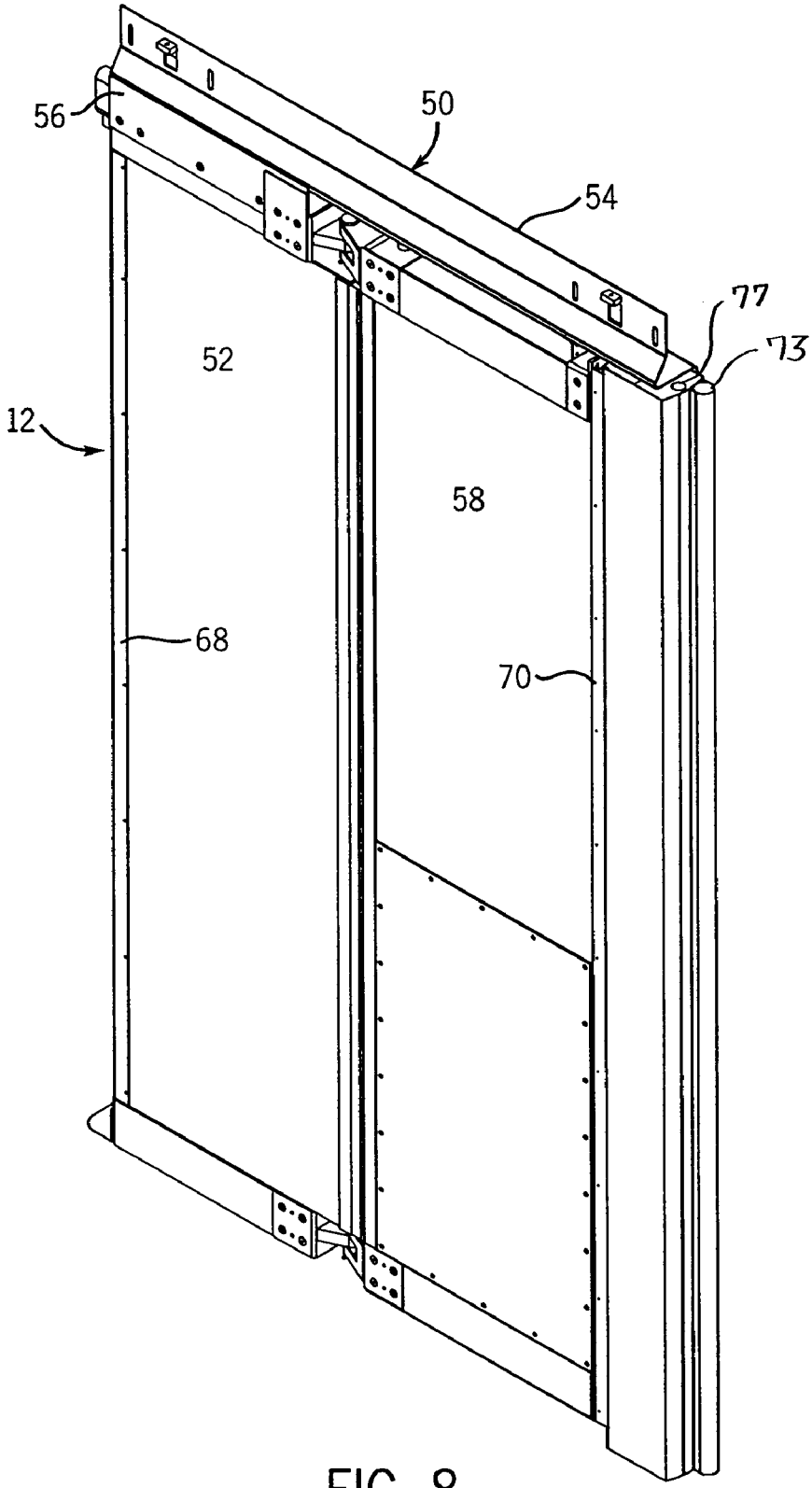
FIG. 8 is a perspective view of the left-hand door assembly of FIG. 1 with the swinging panel in the normal position, and without the track or trolleys.
Figure 9:
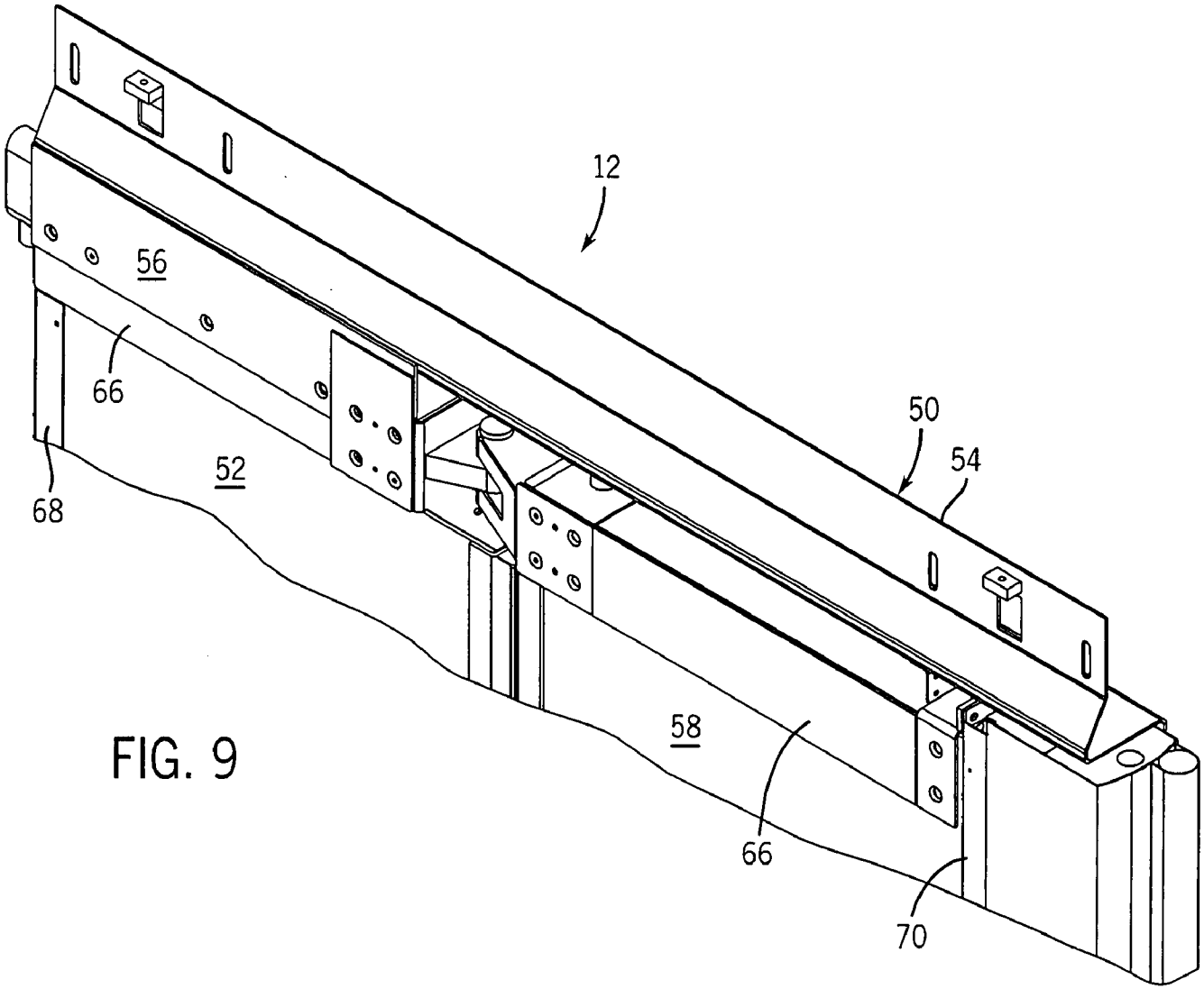
FIG. 9 is a detail view of a top portion of the assembly of FIG. 8.

Referring also to FIGS. 8 and 9, which show only the door panel assembly 12. The door panel assembly 14, which is the mirror image of assembly 12, is the same and this description applies to it also except as otherwise noted. Each door panel assembly includes a header 50 at its top, to which the trolleys are bolted or otherwise affixed. The header 50 is bolted or otherwise affixed to the track panel 52 of the assembly 12. The header 50 has a beam section 54 which extends for substantially the entire width of the door panel assembly 12 and, in the area over the track panel 52 has flanges 56, preferably on both sides of the panel 52 which are bolted to the panel 52, or otherwise suitably affixed. Flanges 56 are provided on both sides of the panel 52 and the top of the panel 52 is inserted between the flanges 56, and the bolts may either extend all the way from one flange 56 to the other, or the bolts may extend into the panel 52 through holes in each flange 56 if separate bolts are used. Separate bolts may be preferable in a refrigeration application so that heat is not conducted from one end of the bolt on one side of the door to the other.

The entire door panel assembly including the track panel 52 and the swinging panel 58 is supported from the track 16 by the header 50. Thus, the swinging panel 58 is essentially cantilevered from the track panel 52. Suitable weather stripping or other sealing means (not shown for clarity) is preferably provided between the top of the door panel assembly and the extending portion of the header 50, the extending portion being the portion that is inward from the flanges 56, over the panel 58, to seal off the area between the extending portion of the header 50 and the portion of the door panel assembly which is not directly affixed to the header 50.

Figure 10A:
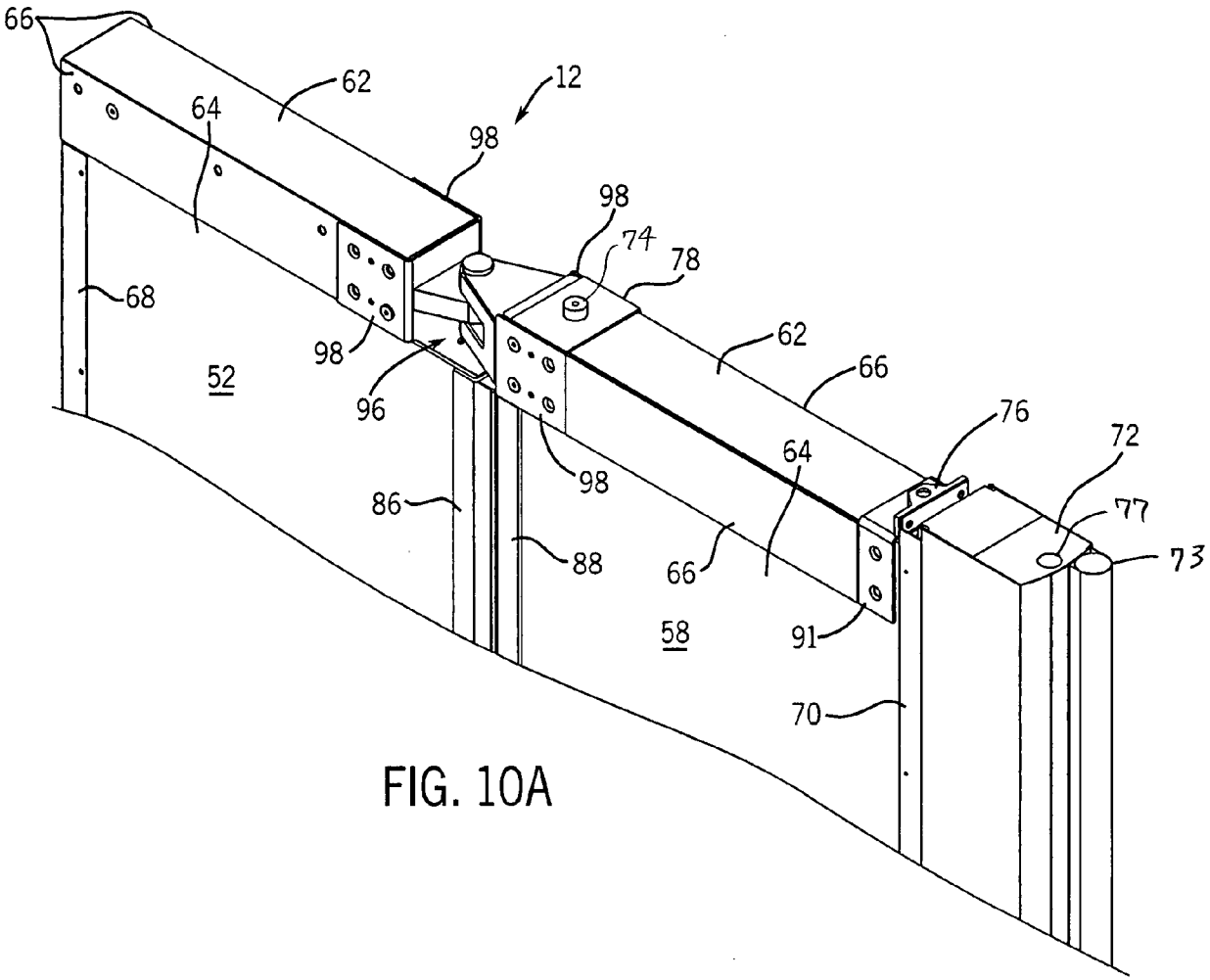
FIG. 10A is a view like FIG. 9, but with the header and sealing elements removed.

Referring to FIG. 10A, it is preferable that if the door panel assembly is to be used for a refrigerated application, that it be an insulating door. To that end, each door panel 52 and 58 has a core 62 (e.g., 4 inches thick) of an insulating material such as expanded polystyrene (eps). For strength and appearance, the core 62 is laminated on each of its two opposite side faces with a fiberglass skin 64. Steel or other high strength material reinforcing strips 66 are laminated to the tops and to the bottoms of the fiberglass skins 64 of each panel 52 and 58, as it is in these areas that the hinges are attached to the door panels 52 and 58. The metal reinforcing strips 66 help prevent tear out of the hinges in the case of a severe impact. In addition, end caps 68 and 70, which may be made of steel, another metal, or plastic, are preferably provided on the outward end of panel 52 and over the inward end of panel 58. This construction also helps provide a door of low weight and therefore low inertia that requires a relatively low accelerating force to get out of the way when it is struck. Other constructions could also be used, and the panels could be hard sided or soft-sided.

Figure 1B:
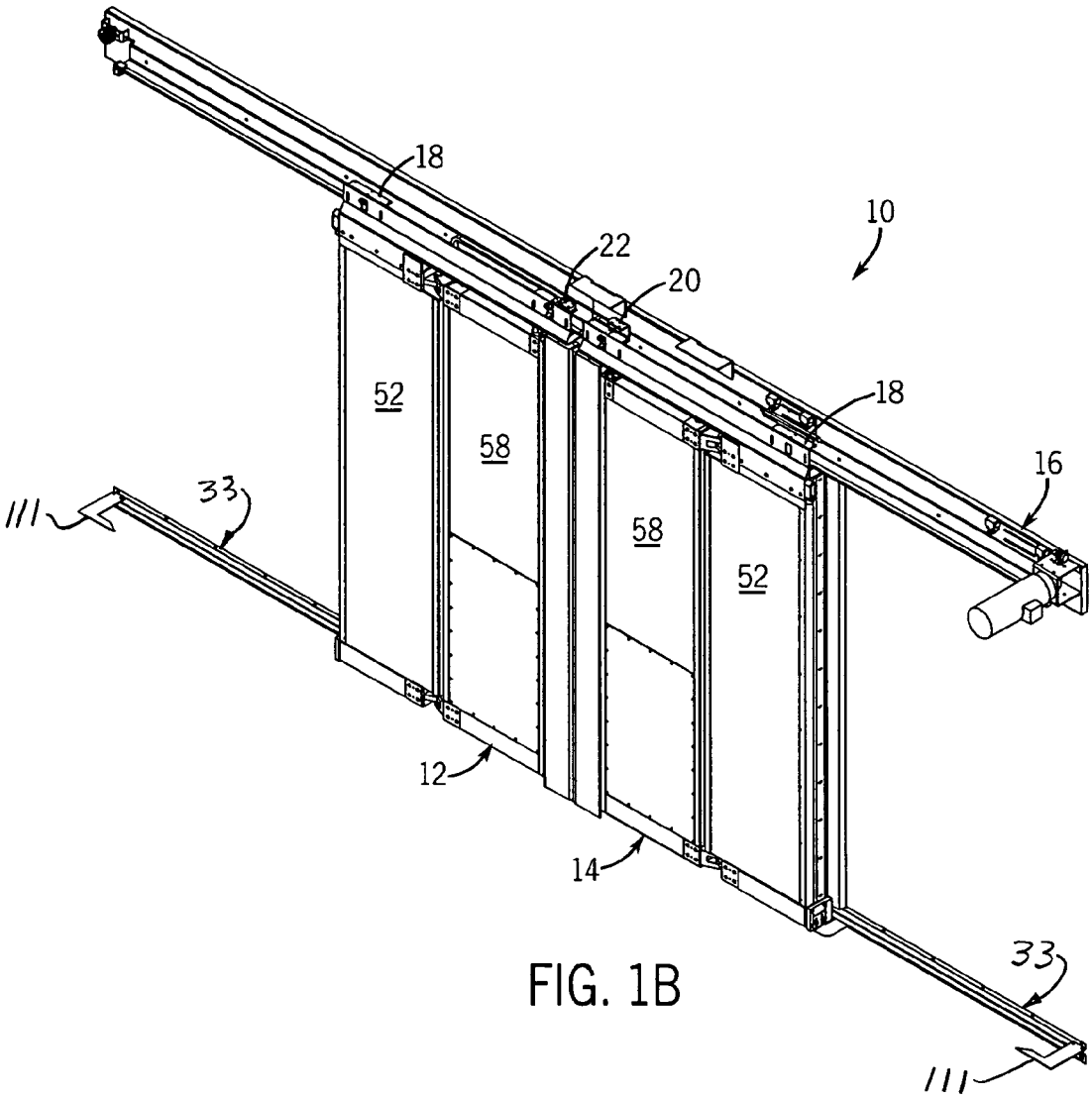
FIG. 1B is a perspective view of the door of FIG. 1A.
Figure 1C:
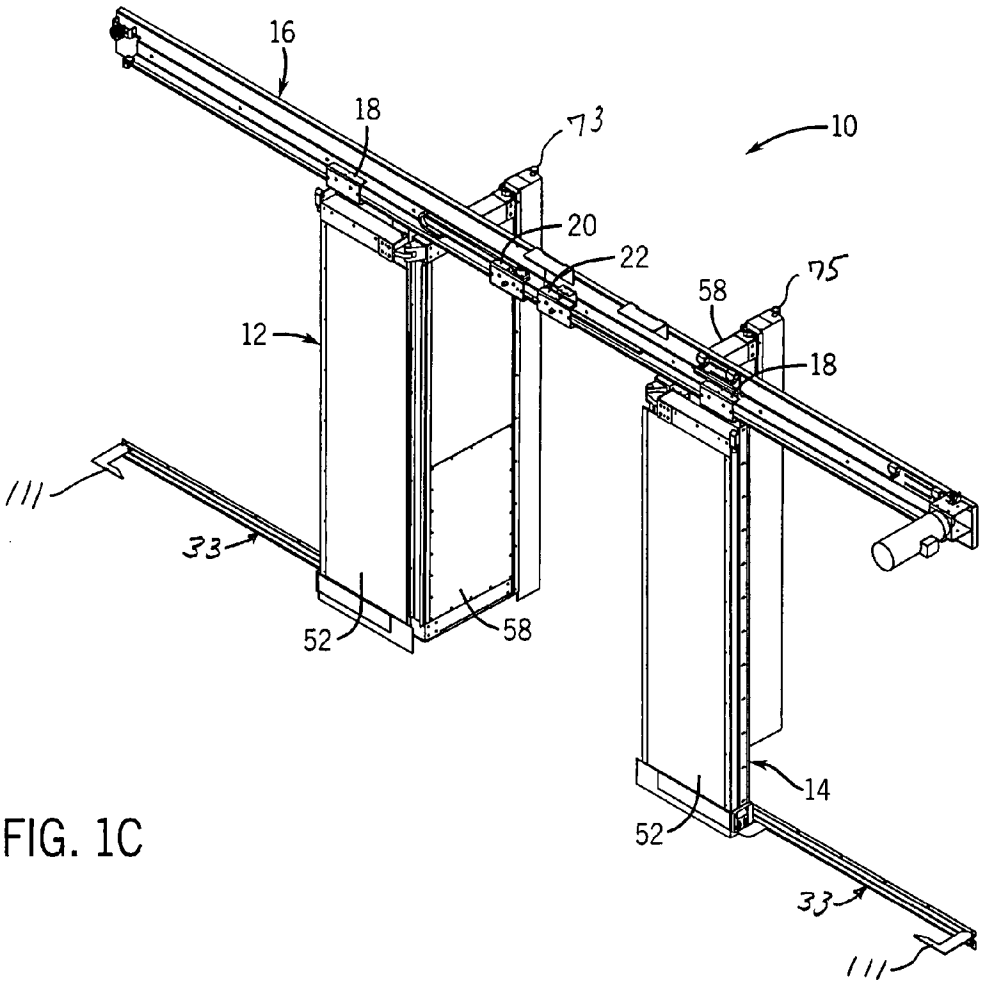
FIG. 1C is like FIG. 1B, but with the swing panels of both door panel assemblies swung inwardly.
Figure 1D:
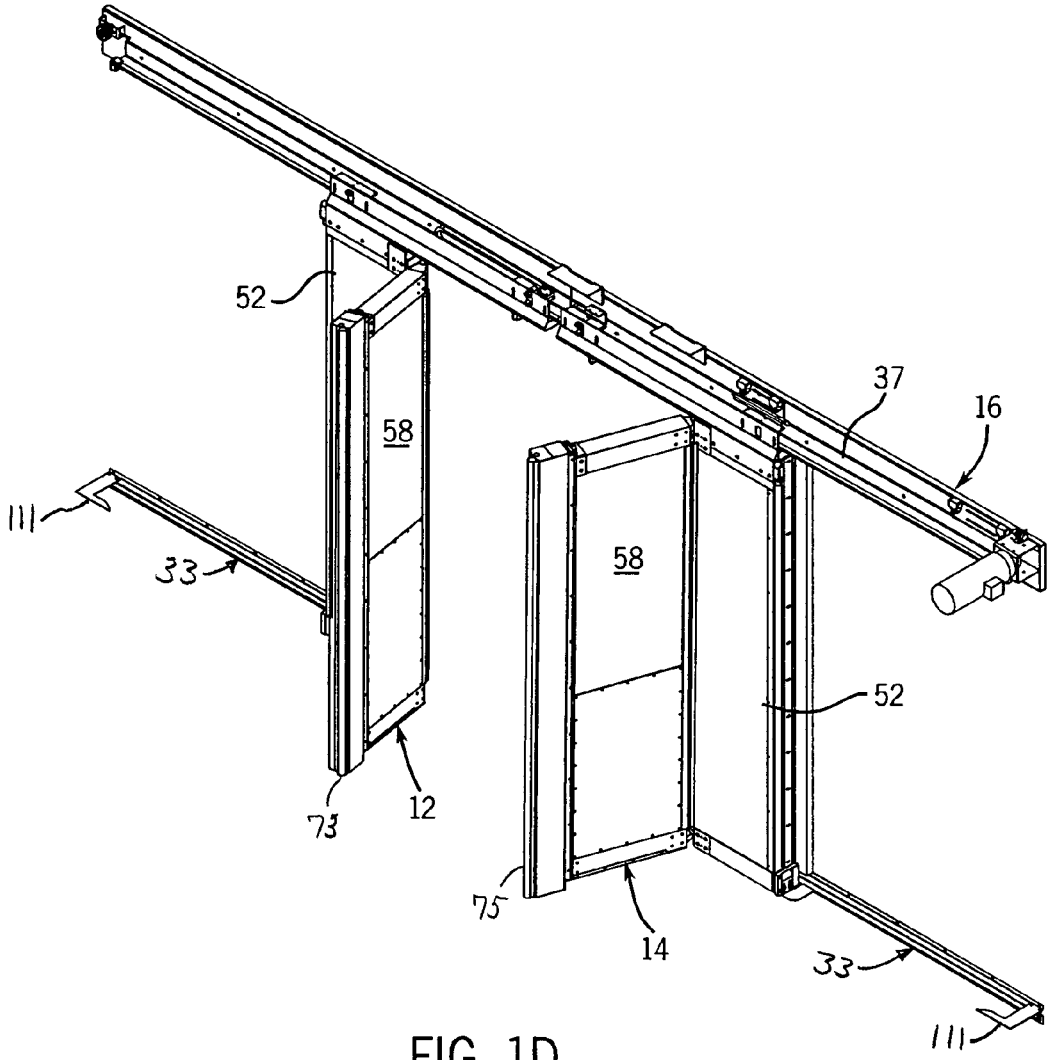
FIG. 1D is like FIG. 1B, but with the swing panels of both door panel assemblies swung outwardly.

The end cap 70 over the inward end of panel 58 mounts at its inward side, a fabric covered foam pad 72 which serves as the leading edge of the assembly 12. The end caps 68 and 70 are channels into which the outward end of the eps/fiberglass lamination of panel 52 and the inward end of the eps/fiberglass lamination of panel 58 are respectively inserted and adhered or otherwise fixedly attached. As shown in FIGS. 1C, 1D and 10A, the inward or exposed end of each foam pad 72 may be radiused with a convexity, and tubes 73 and 75 may be provided in sleeves secured to the leading edges, one on one side and the other on the other side of the respective leading edges, on the respective assemblies 12 and 14, so that they overlap when the panels are closed to provide a better seal when closed. Also, since both leading edges are made of foam, they may be precompressed with each closing of the door, to create a better seal. Also, as is known in the art, each leading edge may be provided with a pressure tube 77 (FIGS. 8 and 10A) having a sensor that detects pressure changes in the tube 77 to detect if the leading edge has been compressed, for example by bumping into a vehicle, to trigger opening of the door.

The panel 58 also has a gas spring attachment 74 and a center detent block 76 attached to its top. Any suitable means of attachment may be used, and as illustrated, the gas spring attachment 74 is attached by being mounted on a sheet metal yoke that is adhered to the plates 66 or otherwise affixed thereto, and the detent block 76 is also mounted on the bent-up flange of a yoke that is adhered or otherwise fixedly attached to the strips 66. The yokes 78 and 80 may have legs which extend on both sides of the panel 58 for a very secure connection with adhesive, bolts, or other suitable means, or may be attached to the flanges 98 of the hinge 96 for a secure connection with the door panel 58.

Figure 12A:
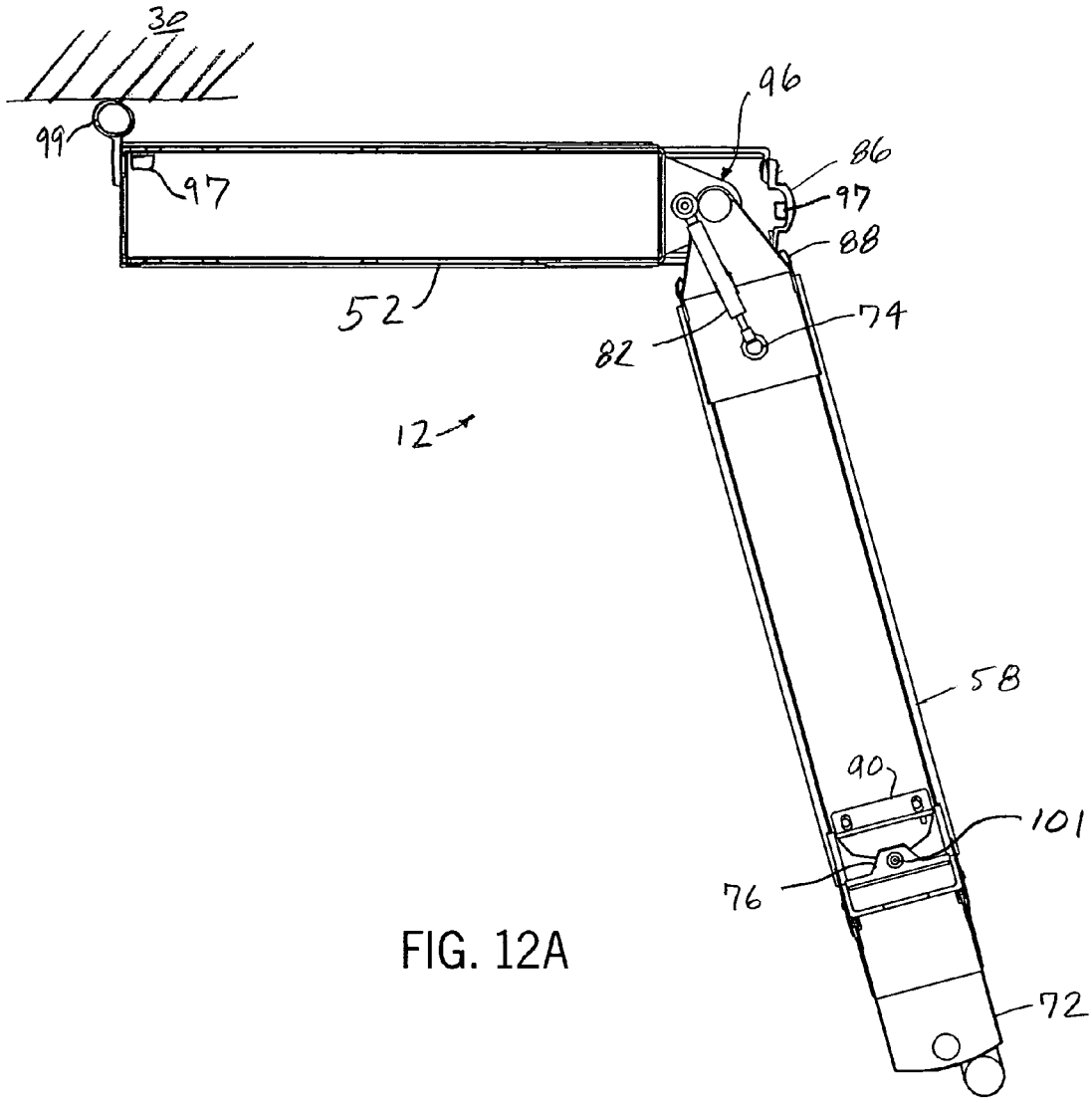
FIG. 12A is a top schematic view illustrating the door with the swinging panel swung open and illustrating the gas spring.
Figure 12B:
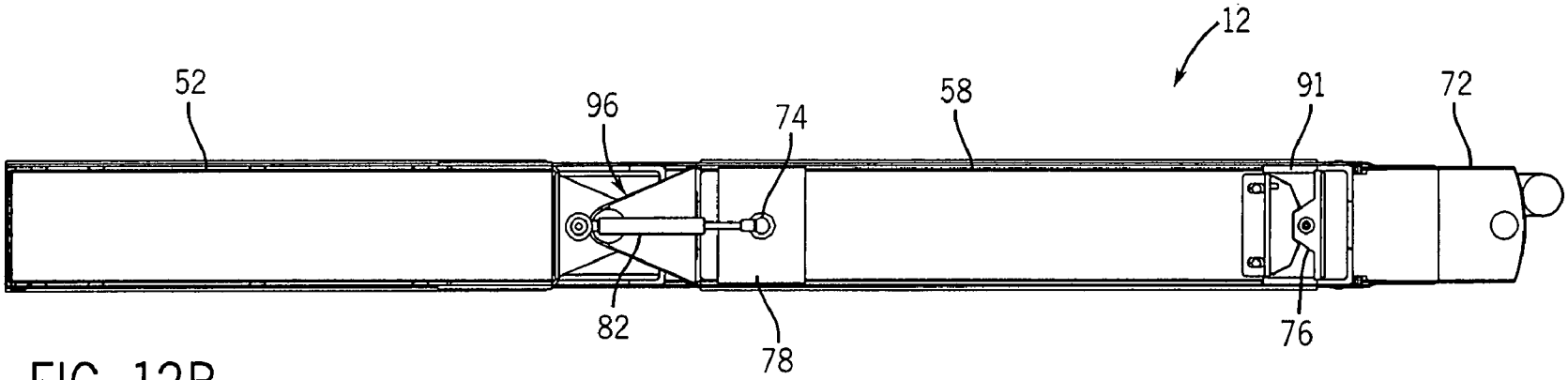
FIG. 12B is a view like FIG. 12A, but with the swinging panel in the normal, closed position.

FIGS. 12A and 12B illustrate the gas spring 82. The gas spring 82 is a constant force compression spring, and other types of compression springs or other centering mechanisms may be used to bias the panel 58 back into the plane of the panel 52 if it is swung one way or the other out of the plane of panel 52. One end of the gas spring 82 is attached to the gas spring attachment 74, and the other end is attached to the header 50 so that the hinge axis of the panel 58 relative to the panel 52 is on a line between the two ends of the gas spring when the panel 58 is aligned in the plane of the panel 52, as shown in FIG. 12B. It is also noted in FIG. 12A that the inward edge of panel 52 has a seal 86 that presents an inward facing convex surface, and the outward end of panel 58 has a seal 88 with an outward facing concave surface that mates with the convex surface of the seal 86, the radii of the concave and convex surfaces being centered on the hinge axis of the panel 58 relative to the panel 52. This helps seal the space between the outward end of the panel 58 and the inward end of the panel 52 when the door is closed with the panel 58 in the plane of the panel 52 as shown in FIG. 12B. The gas spring 82 biases the panel 58 into the plane of the panel 52 regardless of whether the panel 58 is swung clockwise or counter-clockwise relative to the panel 52.

In addition, heat tape 97, preferably of the self-regulating type, may be provided at areas of the door where frost or ice may otherwise form. This may include, for example, on the cold side at the outside corner of the panel 52, running vertically down the corner for substantially the height of the panel 52 (illustrated in FIG. 12A), inside the seal 86 running vertically for substantially the height of the seal 86 (illustrated in FIG. 12A), and in the bottom of each of the panels 52 and 58 running horizontally along the bottom surfaces, inside the door preferably (not shown). A bulb seal 99 (FIG. 12A) may also be provided at the corner of each panel 52 that extends toward the wall 30 of the opening in which the door is installed, so as to seal against the wall when the door is shut. The door may be installed in the opening so that is moves slightly away from the wall and from the floor so that the door seals only contact the adjacent walls and floor in the closed position of the door.

Figure 12C:
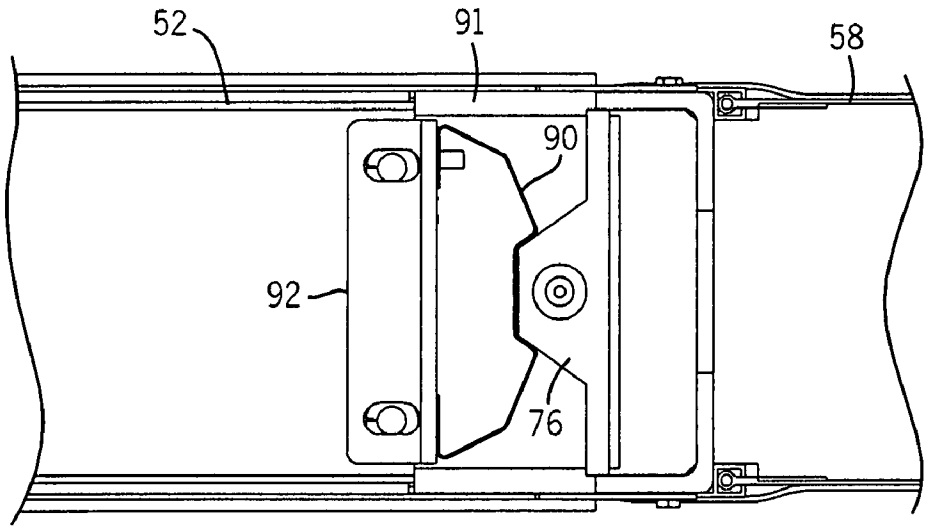
FIG. 12C is a top plan detail view of the detent for holding the swinging panel in the normal position, not showing the header so that the detent spring is visible.
Figure 12D:
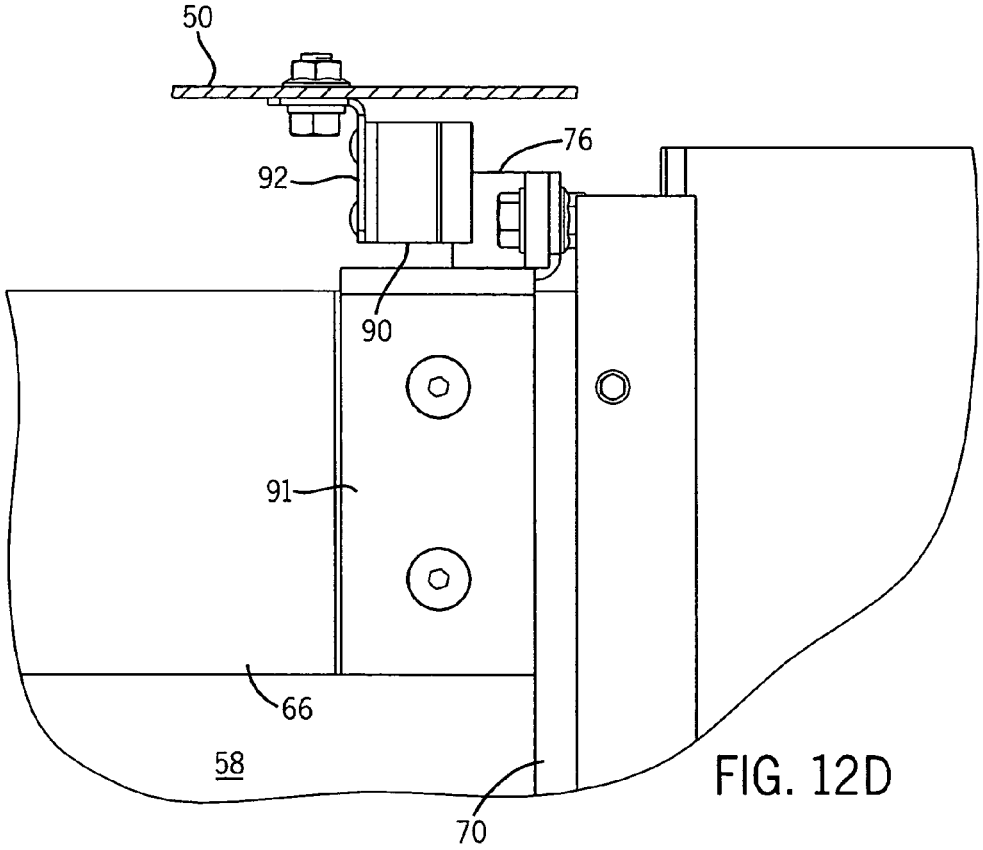
FIG. 12D is a side view of the detent, showing the detent spring bolted to the header.
Figure 12E:
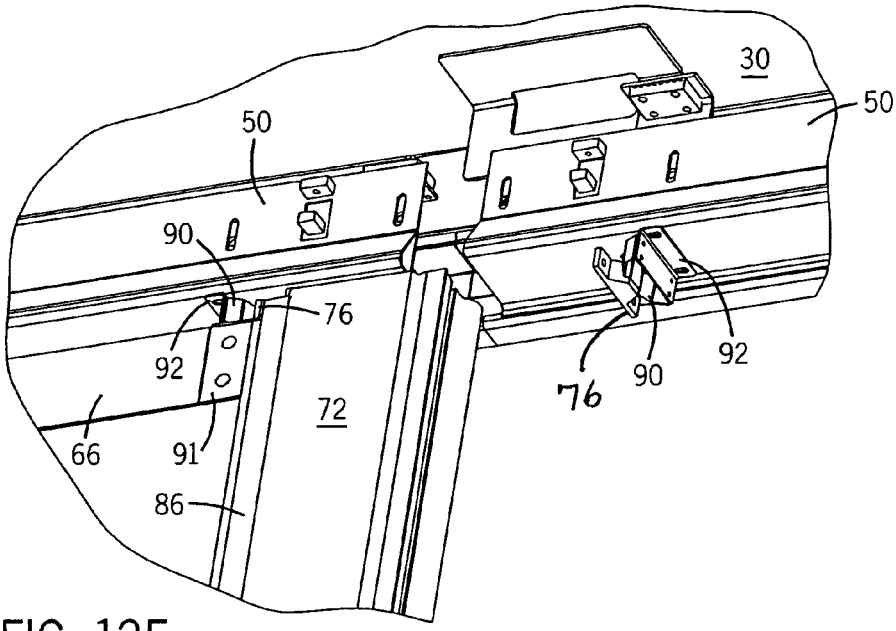
FIG. 12E is a partial perspective view illustrating the detent spring fixed to the header.

The centered detent block 76 is also illustrated in FIGS. 12A and 12B and is further illustrated in FIGS. 12C-E. The block itself is preferably made out of a hard and lubricious plastic material (e.g., UHMW polyethylene) so that it can slide easily on the lead-in ramps of the spring detent 90 and snap positively into engagement with the spring 90 in the center position. The spring 90 is bolted or otherwise suitably fastened to the header 50 by a bracket 92. The block 76 (shown by itself in FIG. 12E relative to spring 90) is attached to the top of the swinging panel 58 and rides up on the ramped sides of the spring 90 when it is returning to the centered position, and when it reaches the center of the spring 90, it snaps into the centered position shown in FIGS. 12C and 12D. The spring 90 flexes to release it from the centered position upon impact or other force sufficient to overcome the detent, in either direction. In addition, a magnet 101 can be embedded or fastened to the block 76 or elsewhere on the panel 72 and a magnetically actuated reed switch installed on the header 50 that is actuated by the magnet, so as to provide an electrical signal indicative of whether the panel 58 is in the plane of the panel 52 or is swung out of that plane.

Figure 10B:
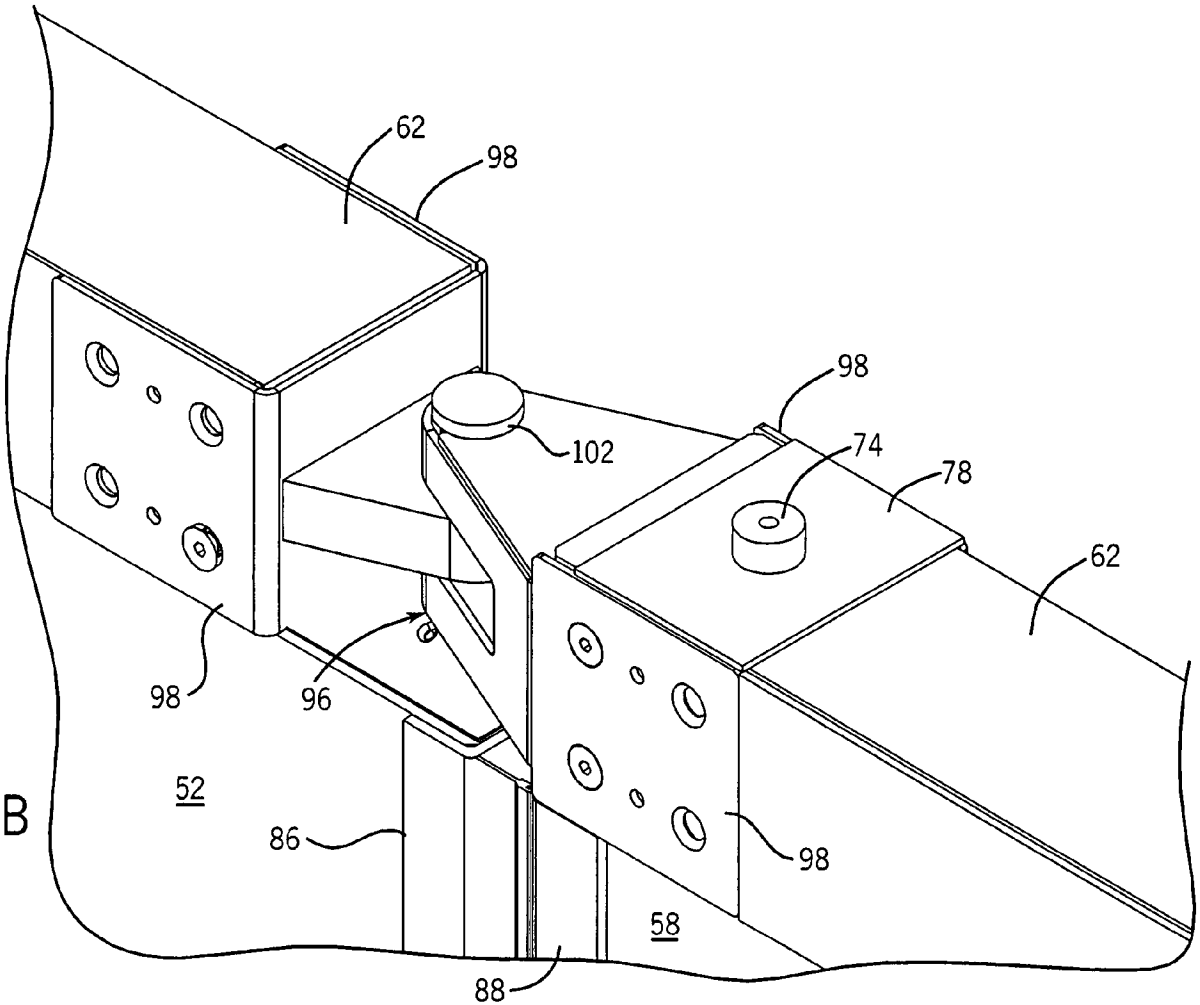
FIG. 10B is a detail view of FIG. 10A in the top hinge area.
Figure 11:
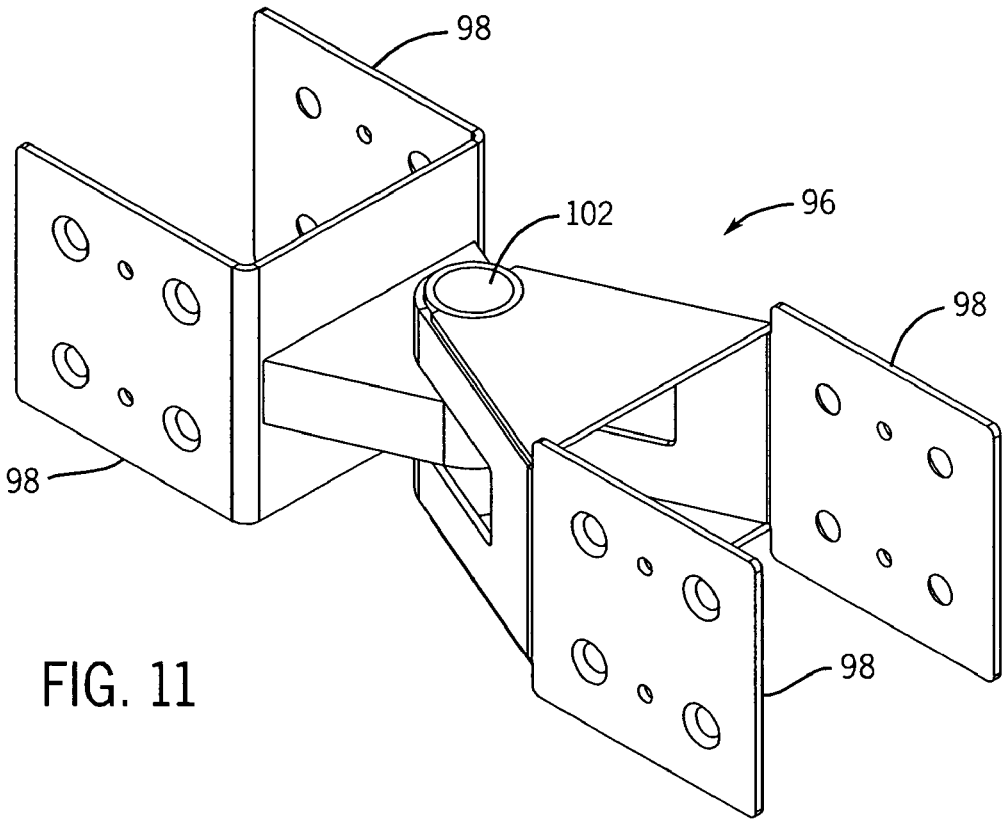
FIG. 11 is a perspective view of a hinge for the door assembly, each door panel assembly having two such hinges, one at the top and one at the bottom between the two panels.

Referring to FIGS. 10A, 10B, and 11, the hinges 96 are as illustrated in FIG. 11. To fit these to the door panels, the two (upper and lower) outward corners are cut out of the panel 52 to form a recess so as to substantially close the gap between the inward end of panel 52 and the outward end of swinging panel 58. Any remaining gap is substantially closed by the seals 86 and 88 as described above. The hinge 96 has opposed yokes that receive the thickness of the panels 52 and 58, over the reinforcing panels 66, and the yoke flanges 98 of the hinge are bolted or otherwise suitably affixed to the respective panels 52 and 58. On each side of the assembly 12, both the upper hinge 96 at the upper corner of the panel 52 and the lower hinge 96 at the lower corner of the panel 52 may be covered, for example by a rubber or other material cover, on both sides of the hinge so as to weatherstrip the hinge area to prevent heat transfer or any significant open spaces at those locations. The axis of hinge pin 102 defines the vertical axis about which panel 58 hinges in or out relative to the panel 52. The hinge pin 102 at the upper hinge 96 is coaxial with the hinge pin 102 at the lower hinge 96.

Figure 13:
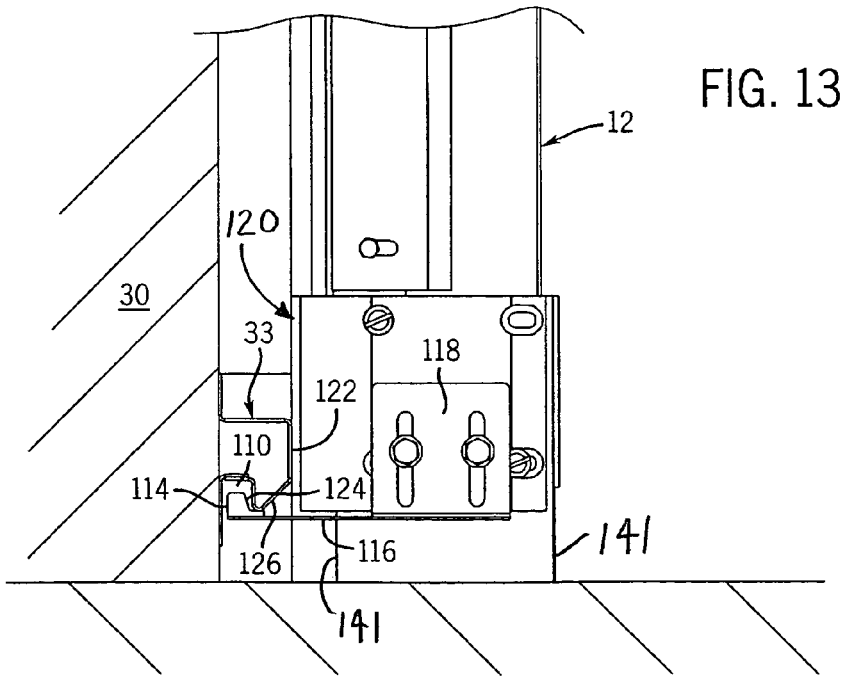
FIG. 13 is a left end view of the left door panel assembly shown in FIG. 1 illustrating a track secured to the adjacent wall near the bottom of the door panel assembly and a releasable spring lever secured to the bottom of the door which engages the track.

Referring to FIG. 13, at the bottom of each door panel assembly 12 and 14, there is preferably provided a rail 33 which is bolted or otherwise suitably affixed to the wall 30. The rail 33 runs lengthwise for at least the length of travel of each door assembly 12 or 14 on the respective side of the doorway and serves to hold the respective door assembly 12 or 14 adjacent to the wall 30 for its entire back and forth travel, in a generally vertical orientation. Rail 33 defines a downwardly facing shoulder 110 which faces toward the wall 30 and behind which a keeper 114 is received from the bottom of the shoulder 110. The keeper 114 is made of a hard and lubricious plastic material, for example UHMW polyethylene, and is fixed to the free end of a cantilever spring 116. The cantilever spring 116 is secured to the bottom of the door panel 52 at the bottom outward corner with bolts or other suitable means, by means of plate 118. A wear block 120 is also mounted on the inward side of the bottom outward corner of the panel 52, which is also made of a hard and lubricious plastic material like UHMW polyethylene, which rubs on the outer surface 122 of the rail 33 as the door assembly 12 travels back and forth. The UHMW wear piece 120 may extend all the way across the thickness of the panel 52 as illustrated in FIG. 13, with the plate 118 fitting in a groove of the wear piece 120.

In any event, the door assemblies 12 and 14, being fitted with the releasable connection provided by the rail 33 and spring 116 arrangement, can be easily dislodged from the rail 33 if it is hit on its inward side, i.e. its side facing the wall 30. If so, the slightly angled surface 124 on the keeper 114 cams against the inwardly facing surface of the shoulder 110 to flex spring 116 downwardly as door assembly 12 pivots away from the wall 30, about the horizontal axis provided by the wheels 32 and rail 34. The door assemblies 12, 14 are thereby released from being held adjacent to the wall 30. When the obstruction is removed, the door assemblies 12, 14 are free to rotate back to their position adjacent to the wall 30, and when they do, the keeper 114 cams on the angled surface 126 of the rail 33, which flexes the spring 116 downwardly and permits keeper 114 to reengage behind the inwardly facing surface of the shoulder 110, back into the position shown in FIG. 13. As shown in FIG. 1B, re-engagement members 111 may be provided near the ends of the rail 33 that cam on the wear pieces 120 when the door is near fully opened to move the door panel assemblies 12 and 14 back toward the wall 30 and the keeper 114 back into re-engagement with the rail 33.

The leading edge may be approximately six inches, and the entire width of the second panel may be approximately 30 inches, for example, with the first panel that is supported by the trolleys from the track, also being about 30 inches wide or so, but any dimensions may be applied to a door of the invention. In addition, an impact plate 133 as shown in FIG. 1A may be provided covering at least the lower portion of each swinging panel 58 over the fiberglass skins, to absorb impacts and preserve the surface finish. The impact plates are preferably made of a tough material, such as ⅛ inch thick UHMW polyethylene.

Many modifications and variations to the preferred embodiment described will be apparent to those skilled in the art. Therefore, the invention should not be limited to the embodiment described, but should be defined by the claims which follow.

We claim:

1. A laterally sliding door for closing off a doorway, comprising:

a track panel that extends vertically for substantially the height of the doorway and horizontally between an inward edge of the track panel and an outward edge of the track panel so as to cover a portion of the doorway when the door is closed;

a header for mounting the track panel to a track along which the track panel slides laterally when opening and closing the door;

one or more hinges at the inward edge of the track panel, the inward edge being the edge which is in the direction of door closing; and a swinging panel pivotally attached to the hinges of the track panel at the inward edge of the track panel, the swinging panel being pivotable from the plane of the track panel in either direction about a substantially vertical axis through the one or more hinges of the track panel when the swinging panel is impacted from one side or the other by a forklift truck so as, in the event of an impact by a forklift truck from either side, to absorb a portion of the impact and move out of the way of the forklift truck;

wherein the track panel and swinging panel can pivot in at least one direction about a substantially horizontal axis.

2. The improvement of claim 1, wherein two such door panel assemblies are provided that meet in approximately the center of the doorway and open by moving along the doorway in opposite directions.

3. The improvement of claim 1, wherein the swinging panel is biased to a normal position in which is it aligned with the plane of the track panel.

4. The improvement of claim 1, wherein the swinging panel is detented in a position in which is aligned with the plane of the track panel such that the swinging panel tends to stop in said position.

5. The improvement of claim 1, wherein the track panel is rigid.

6. The improvement of claim 5, wherein the track and swinging panels are rigid.

7. The improvement of claim 5, wherein the track and swinging panel are made of an expanded polystyrene core and fiberglass skins.

8. The improvement of claim 1, further comprising an impact plate covering at least the lower portion of each swinging panel on both sides of each swinging panel.

9. The improvement of claim 1, further comprising a releasable mechanism which holds the bottom of the door panel assembly so that the door panel assembly is in a substantially vertical plane in a normal position of the door panel assembly.

10. The improvement of claim 9, wherein the mechanism comprises a re-engagement member that cams on the door to move the door panel assembly to the normal position when the door is moved along the doorway.

11. The improvement of claim 1, wherein the header extends over the swinging panel and mounts part of a detent mechanism that holds the swinging panel aligned with the plane of the track panel in a normal position of the swinging panel.

12. The improvement of claim 1, wherein a heat tape is provided adjacent to at least one of the edges of the panels.

13. The improvement of claim 1, wherein each of the track panel and the swinging panel are substantially the height of the doorway.

14. The improvement of claim 1, further comprising a sensor at a leading edge of the swinging door that detects if the leading edge has been impacted.

15. The improvement of claim 1, further comprising a sensor that detects if the swinging door has been swung out of the plane of the track panel.

16. A laterally sliding door for closing off a doorway, comprising:

a track panel that extends vertically for substantially the height of the doorway and horizontally between an inward edge of track panel and an outward edge of the track panel so as to cover a portion of the doorway when to door is closed;

a header for mounting the track panel to a track along which the track panel slides laterally when opening and closing the door;

one or more hinges at the inward edge of the track panel, the inward edge being the edge which is in the direction of door closing; and a swinging panel pivotally attached to the hinges of the track panel at the inward edge of the track panel, the swinging panel being pivotable from the plane of the track panel in either direction about a substantially vertical axis through the one or more hinges of the track panel when the swinging panel is impacted from one side or the other by a forklift truck so as, in the event of an impact by a forklift truck from either side, to absorb a portion of the impact and move out of the way of the forklift truck;

further comprising a releasable mechanism which holds the bottom of the door panel assembly so that the door panel assembly is in a substantially vertical plane in a normal position of the door panel assembly;

wherein the mechanism comprises a rail mounted to a wall adjacent to the door panel assembly and a leaf spring mounted to the door panel assembly, with a keeper on the end of the leaf spring that is engaged with the rail in the normal position of the door panel assembly.

17. The improvement of claim 16, wherein the mechanism further comprises a re-engagement member that re-engages the keeper with the rail when the door is moved along the doorway.

18. A laterally sliding door for closing off a doorway, comprising:

a track panel that extends vertically for substantially the height of the doorway and horizontally between an inward edge of the track panel and an outward edge of the track panel so as to cover a portion of the doorway when the door is closed;

a header for mounting the track panel to a track along which the track panel slides laterally when opening and closing the door;

one or more hinges at the inward edge of the track panel, the inward edge being the edge which is in the direction of door closing; and a swinging panel pivotally attached to the hinges of the track panel at the inward edge of the track panel, the swinging panel being pivotable from the plane of the track panel in either direction about a substantially vertical axis through the one or more hinges of the track panel when the swinging panel is impacted from one side or the other by a forklift truck so as, in the event of an impact by a forklift truck from either side, to absorb a portion of the impact and move out of the way of the forklift truck;

wherein the track panel is fixed to the header and the header can pivot in at least one direction about a substantially horizontal axis.

* * * * *